US007314155B2

(12) United States Patent
Moeller et al.

(10) Patent No.: US 7,314,155 B2
(45) Date of Patent: Jan. 1, 2008

(54) MODULAR MAGAZINE FOR FASTENER-DRIVING TOOL

(75) Inventors: Larry M. Moeller, Schaumburg, IL (US); Walter J. Taylor, McHenry, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/207,426

(22) Filed: Aug. 18, 2005

(65) Prior Publication Data

US 2006/0091179 A1 May 4, 2006

(51) Int. Cl.
*B25C 7/00* (2006.01)
*B25C 1/04* (2006.01)

(52) U.S. Cl. ..... 227/127; 227/8; 227/120; 227/125; 227/109

(58) Field of Classification Search ..... 227/120, 227/109, 128, 136, 8, 135, 125, 127; 81/434, 81/435
See application file for complete search history.

(56) References Cited

U.S. PATENT DOCUMENTS

| | | | | |
|---|---|---|---|---|
| 2,946,059 | A * | 7/1960 | Wandel | 227/136 |
| 3,266,697 | A | 8/1966 | Fiedler | |
| 3,437,249 | A | 4/1969 | Baum | |
| 3,797,723 | A * | 3/1974 | Perkins et al. | 227/109 |
| 4,139,136 | A | 2/1979 | Catalano | |
| 4,433,782 | A * | 2/1984 | Figge et al. | 206/338 |
| 4,558,811 | A * | 12/1985 | Klaus | 227/116 |
| 4,805,824 | A * | 2/1989 | Erickson | 227/120 |
| 5,192,012 | A | 3/1993 | Schafer et al. | |
| 5,626,274 | A * | 5/1997 | Shkolnikov et al. | 227/109 |
| 6,161,746 | A * | 12/2000 | Wey | 227/109 |
| 6,708,861 | B2 * | 3/2004 | Osuga et al. | 227/120 |
| 7,044,351 | B2 * | 5/2006 | Ronconi | 227/123 |
| 7,117,622 | B2 * | 10/2006 | Freed et al. | 42/7 |
| 2003/0010803 | A1 | 1/2003 | Schuster | |
| 2005/0133393 | A1 * | 6/2005 | Lawrence et al. | 206/349 |

FOREIGN PATENT DOCUMENTS

| | | |
|---|---|---|
| FR | 2554751 | 5/1985 |

* cited by examiner

*Primary Examiner*—Rinaldi I. Rada
(74) *Attorney, Agent, or Firm*—Greer, Burns & Crain, Ltd.; Lisa M. Soltis; Mark W. Croll

(57) ABSTRACT

A modular magazine assembly in a fastener-driving tool having a nosepiece includes a first magazine housing portion secured to the tool and at least partially defining a chamber for fasteners. An extension portion is configured for releasable attachment to the first magazine housing portion. Upon assembly of the extension portion, a resulting large capacity magazine is defined and dimensioned to accommodate at least two fastener strips.

11 Claims, 7 Drawing Sheets

MODULAR MAGAZINE FOR FASTENER-DRIVING TOOL

BACKGROUND

The present invention relates generally to fastener-driving tools used to drive fasteners into workpieces, such tools typically being powered by combustion, pneumatics, electricity, powder activated or by other sources.

Fastener-driving tools typically include a housing enclosing a power source which drives the fasteners, a handle or grip and a magazine to hold and advance fasteners for driving into the workpiece by the power source. Fasteners for such tools are typically provided in linear strips in which adjacent fasteners are held together with adhesive, welded wire, plastic or paper webbing, collation strips or the like. In the magazine, a follower biased by a return spring urges the fasteners from a rear end of the magazine, typically where the fasteners are loaded into the magazine, to the front end of the magazine which is adjacent a nosepiece/shear block. In the nosepiece/shear block, the fasteners are impacted by a reciprocating drive blade and driven into the workpiece.

Conventional tools typically are provided with magazines capable of holding either single or double fastener strips. Pneumatic framing tools are manufactured almost exclusively with two strip capacity magazines, since these tools are used in production applications where large volumes of fasteners are driven. The larger capacity magazine reduces the reloading interruption period by 50%.

In contrast, cordless portable fastener driving tools, especially of the framing type, are typically provided only with single fastener strip capacity magazines. The lower capacity of the magazine is designed to improve portability, tool balance and user ergonomics. In addition, cordless tools are intended to be usable in tight or confined areas such as roof trusses and remodeling projects, where longer, higher capacity magazines are a hindrance.

Despite the above-identified conventions, there is a need for users of portable tools to have the ability to load multiple fastener strips at a time for some applications. One proposed solution is to provide multiple magazines, one with a single fastener strip capacity, the other with multiple fastener strip capacity. However, disadvantages of this arrangement include the duplication of magazine components such as return springs, associated brackets, and nosepiece/shear block components, depending on the type of tool being considered, as well as the resulting additional weight, bulk and cost. Another disadvantage of multiple magazines is the problem of jobsite storage of the spare magazine.

Thus, there is a need for a fastener-driving tool having the capability of employing either one or multiple fastener strips, and in a way that addresses the problems discussed above.

BRIEF SUMMARY

The above-listed needs are met or exceeded by the present modular magazine for a fastener-driving tool. A fastener-driving tool is provided with a standard magazine with the capacity for a single strip of fasteners. In one embodiment, an optional removable endcap of the magazine is replaced with a magazine extension that is fastened to the standard magazine. A specially designed fastener follower is provided to the standard magazine to enable use with either single or multiple fastener strips. As such, several magazine components, especially those involved with engaging the tool nosepiece, are unchanged and not duplicated. These components include the nail strip follower, nail lockout mechanism and the nosepiece/shear block engagement plates.

In another embodiment, the magazine is provided in at least two main components, one of which remains fixed on the tool during normal use. The complementary portion is provided in two sizes, a single strip and a double strip size. Each complementary portion has its own follower and return spring.

Using the first embodiment, the user can convert from single to multiple strip application by removing the optional endcap, adding the extension, pulling the follower to a load position, and loading the multiple fastener strips. In the second embodiment, the user removes the complementary portion to change the tool between single and multiple fastener strip operation.

More specifically, a modular magazine assembly in a fastener tool having a nosepiece includes a first magazine housing portion secured to the tool and at least partially defining a chamber for fasteners, a second magazine housing portion releasably secured to the tool and, with the first magazine housing portion, defining a magazine for at least one fastener strip. An extension portion is provided and is configured for releasable attachment to the first magazine housing portion upon removal of the second magazine housing portion. Upon assembly of the extension portion, a resulting large capacity magazine is defined and is dimensioned to accommodate at least two fastener strips.

DETAILED DESCRIPTION

Figures 1, 2:
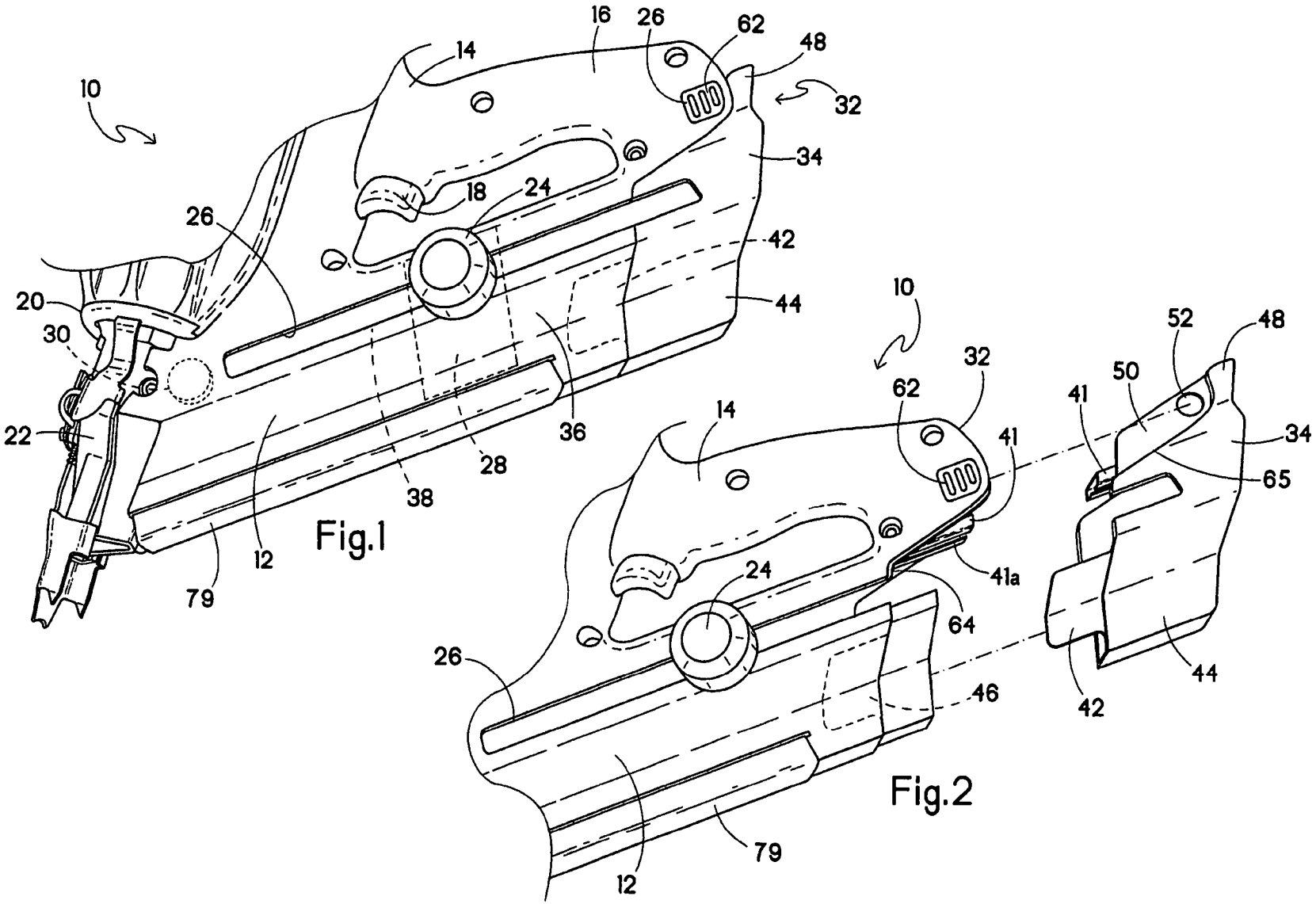
FIG. 1 is a fragmentary perspective view of a fastener-driving tool equipped with the present modular magazine in a single strip format.
FIG. 2 is a fragmentary perspective view of the tool of FIG. 1 with the endcap shown exploded away for installation of the extension.
Figure 10:
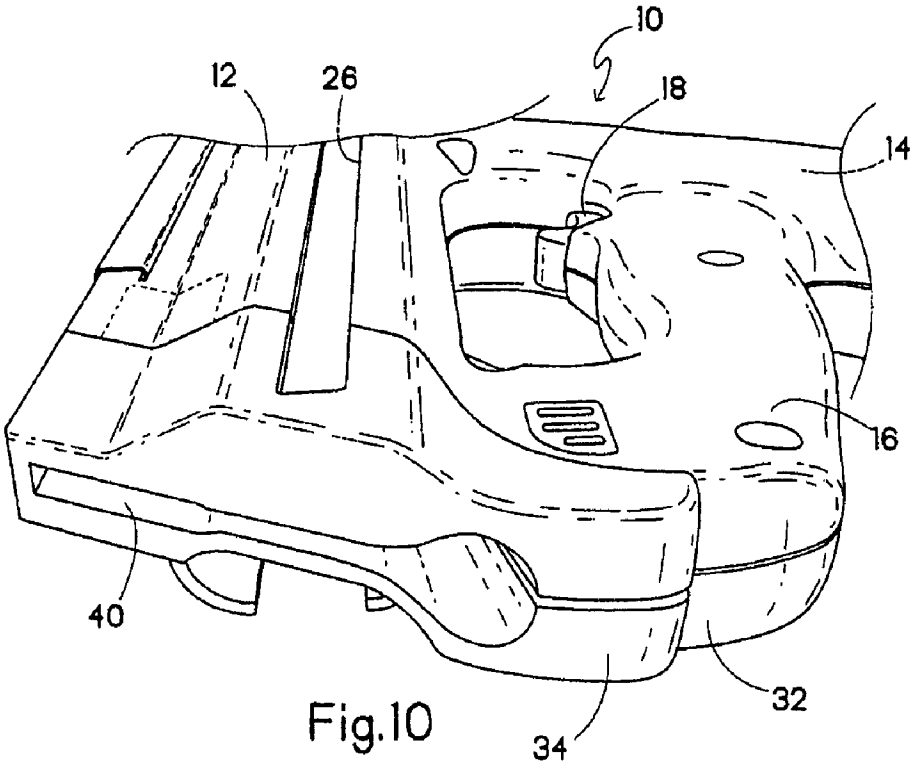
FIG. 10 is a rear elevation view of the tool of FIG. 1.

Referring now to FIGS. 1, 2 and 10, a combustion-powered fastener-driving tool suitable for use with the present modular magazine is generally designated 10. While illustrated as a combustion-powered fastener-driving tool, the tool 10 is contemplated as being any fastener-driving tool, whether combustion powered, pneumatic, electric, powder activated or operated by other power sources, as long as a fastener magazine 12 is employed. In the present application, the entire tool 10 is not depicted since such tools are well known in the art. A main housing 14 provided in single or multiple component format as is known in the art encloses tool components, in some cases including at least a part if not all, of the magazine 12. Included on the housing 14 is a handle portion 16 with a trigger 18. A front end 20 of the tool 10 has a nosepiece or shear block 22 which receives fasteners from the magazine 12 and, through the action of a driver blade (not shown), drives fasteners into the workpiece.

The magazine 12 includes a follower handle 24 slidably engaged in a slot or channel 26 and being connected to a follower 28 (shown hidden). At least one of the follower handle 24 and the follower 28 is connected to a follower return spring 30 (shown hidden) which urges the follower, and fasteners located in the magazine 12, toward the nosepiece 22 as is known in the art. An important feature of the magazine 12 is that the follower return spring 30 has a length greater than that needed for a single strip of fasteners, and preferably has a length suitable for use with at least two strips of fasteners.

Figure 9:
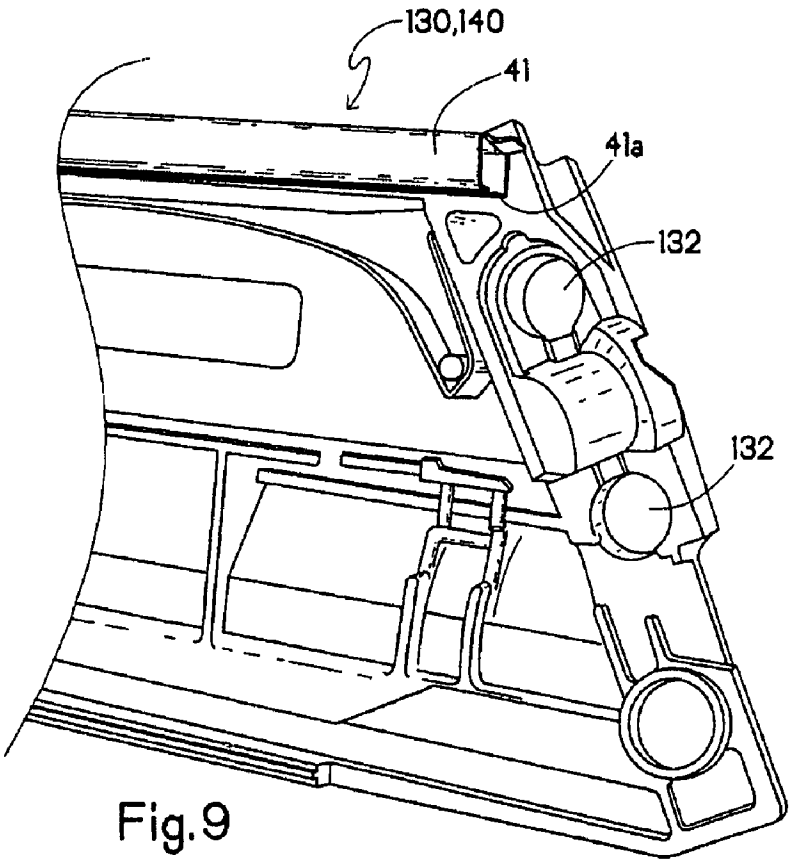
FIG. 9 is a fragmentary perspective view of the inner wall of the magazine housing portion of the tool of FIG. 5.

Opposite the front end 20 of the tool 10, is a rear end 32 provided with a removable endcap 34. Thus, the magazine 12 of FIGS. 1 and 2 is made up of a first magazine housing portion 36 secured to the tool 10 and at least partially defining a chamber 38 (shown hidden) for fasteners, and a second magazine housing portion 34 (in this embodiment the endcap) releasably secured to the tool and, with the first housing portion, defining the magazine having the capacity for accommodating a single strip of fasteners. In this embodiment, the endcap 34 is releasably locked to the housing 14, defines a rear, enclosing end of both the chamber 38 and the channel 26 and also is provided with a fastener feed entry slot 40 (best seen in FIG. 10). The feed entry slot 40 is in communication or registry with a bracket-like fastener track 41 (FIG. 2) having portions located both in the first magazine housing portion 36 and the endcap 34 to guide fasteners toward the nosepiece 22. As is well known in the art, the fastener track 41 has an inverted "U"-shape with spaced, opposing, inwardly extending ribs 41*a* (FIG. 9) for slidably engaging fastener heads. Fastener shanks slide in the space between the ribs.

Figure 4:
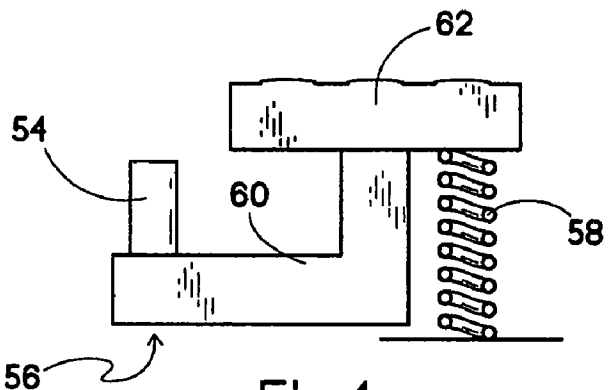
FIG. 4 is a side elevation of the release button used with the tool of FIG. 1.

Referring now to FIGS. 1, 2 and 4, the endcap 34 engages the housing 14 at upper and lower ends, being provided with a tongue 42 for locating a lower end 44 in a recess or pocket 46 (shown hidden) in the magazine 12. At an upper end 48, the endcap 34 is provided with a recessed rib 50 having an aperture 52. The aperture 52 is engaged by a pin 54 on a biased latch button 56 which is urged to a locked position by a biasing element, 58, preferably a coiled spring, however, other known types of springs and other biasing elements are contemplated. The button 56 has an "L"-shaped member 60, which with the pin 54 forms a general "U"-shape when viewed from the side. A finger pad 62 is joined to the member 60 to complete the button 56, which is preferably located within the handle portion 16 of the housing 14, however other suitable locations on the tool 10 are contemplated. In addition to the button 56 and the tongue 42, the endcap 34 may be retained upon the first magazine housing portion 36 by a snap fit arrangement defined in part by a grooved portion 64 (FIG. 2) mating with a rib or tongue 65 on the endcap 34 as is well known in the art.

It will be understood that, while preferred in the embodiment depicted in FIGS. 1, 2 and 10, the endcap 34 is considered optional, and in some cases the magazine 12 is constructed primarily of the first magazine housing portion 36. In such embodiments, the first magazine housing is provided with its own feed entry slot (not shown) which is in communication with the fastener track 41. Thus, a fastener strip is inserted directly into the fastener track 41 at the rear end 32 of the tool 10.

Figure 3:
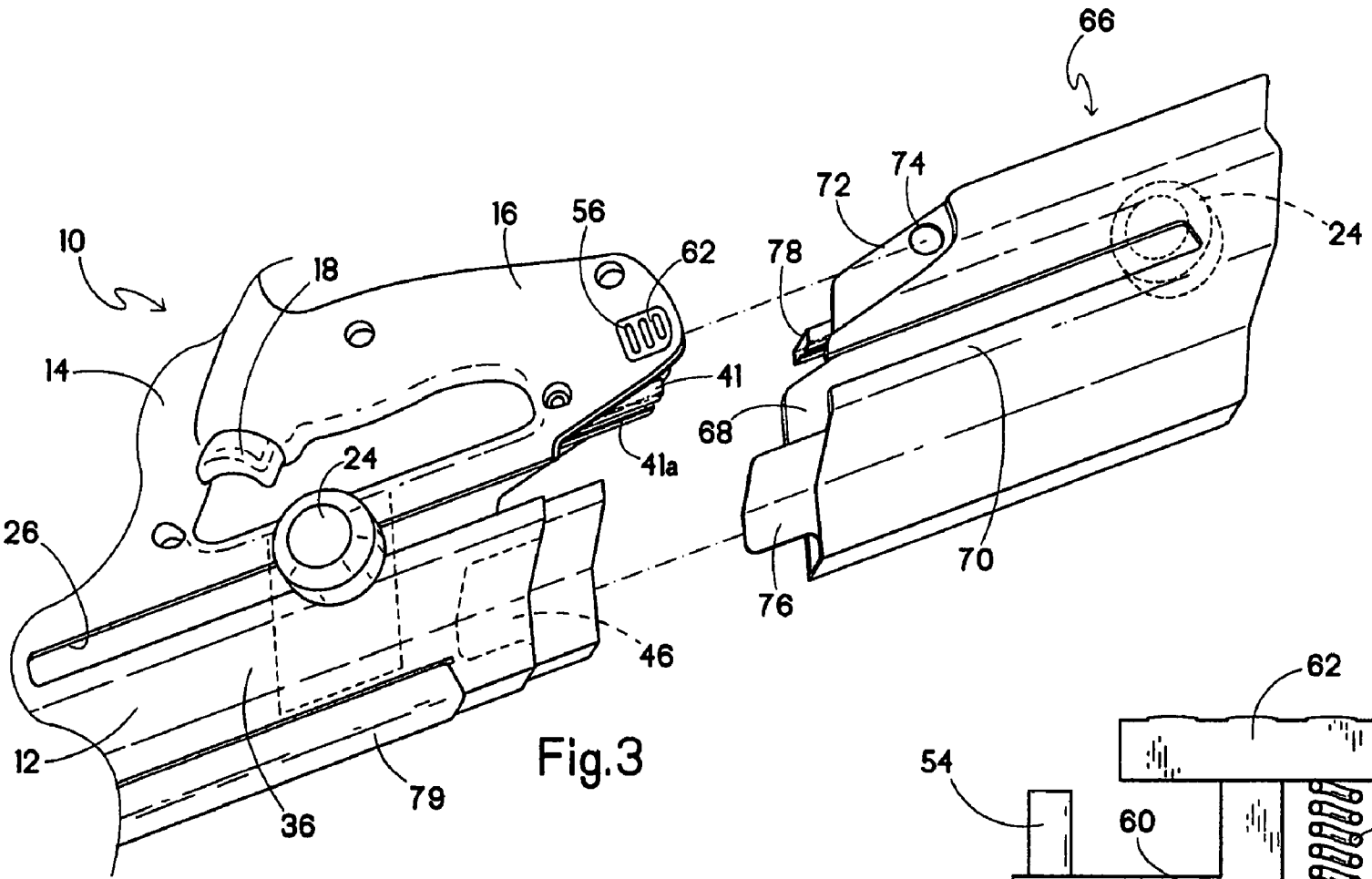
FIG. 3 is a fragmentary perspective view of the tool of FIG. 1 with the extension shown exploded away.

Referring now to FIG. 3, in instances when tool capacity of two or more fastener strips are desired, an extension portion, generally designated 66 and also referred to as an extension, is provided which is configured for releasable attachment to the first magazine housing portion 36 upon removal of the optional endcap 34. The extension portion 66 is generally at least as long, as and preferably longer in length than the endcap 34 to define an extension chamber 68 for accommodating the second or multiple strips of fasteners, and also includes a slot segment 70 in registry with the slot 26. Upon assembly of the extension portion 66 to the first magazine housing portion 36, a recessed rib 72 and aperture 74, similar in construction to the components 50, 52, and a tongue 76 similar in construction to the tongue 42 are used to secure the extension in place, in a similar fashion to the endcap 34.

With the extension portion 66 in place, a resulting large capacity magazine is defined and dimensioned to accommodate at least two fastener strips. Since the follower return spring 30 (FIG. 1) is extra long, the same follower 28 and follower handle 24 are used when multiple fastener strips are inserted into the extended, large capacity magazine. The follower handle 24 is shown in its fully extended position in phantom on the extension portion 66 in FIG. 3. The extension portion 66 is also provided with a fastener track extension 78 in registry with the fastener track 41 on the tool 10 for promoting uninterrupted sliding of fasteners toward the nosepiece 22. Whether the endcap 34 or the extension 66 is installed, the tool 10 is preferably provided with an elongate, generally "U"-shaped clip 79 for securing together lower edges of the magazine 12.

Figures 5, 6:
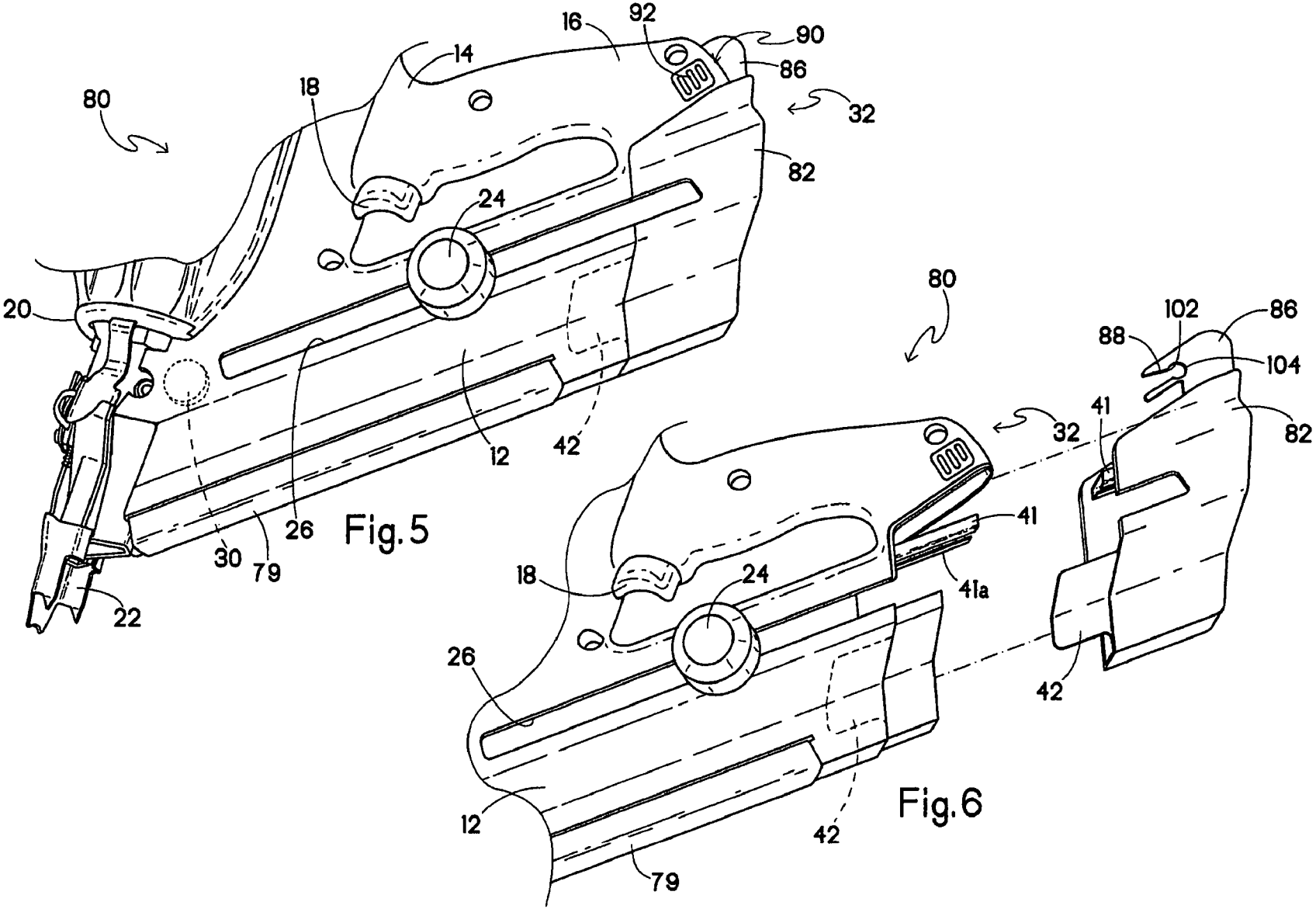
FIG. 5 is a fragmentary perspective view of a fastener-driving tool equipped with an alternate embodiment of the present modular magazine in single strip format.
FIG. 6 is a fragmentary perspective view of the tool of FIG. 5 with the endcap shown exploded away for installation of the extension.
Figures 7, 8:
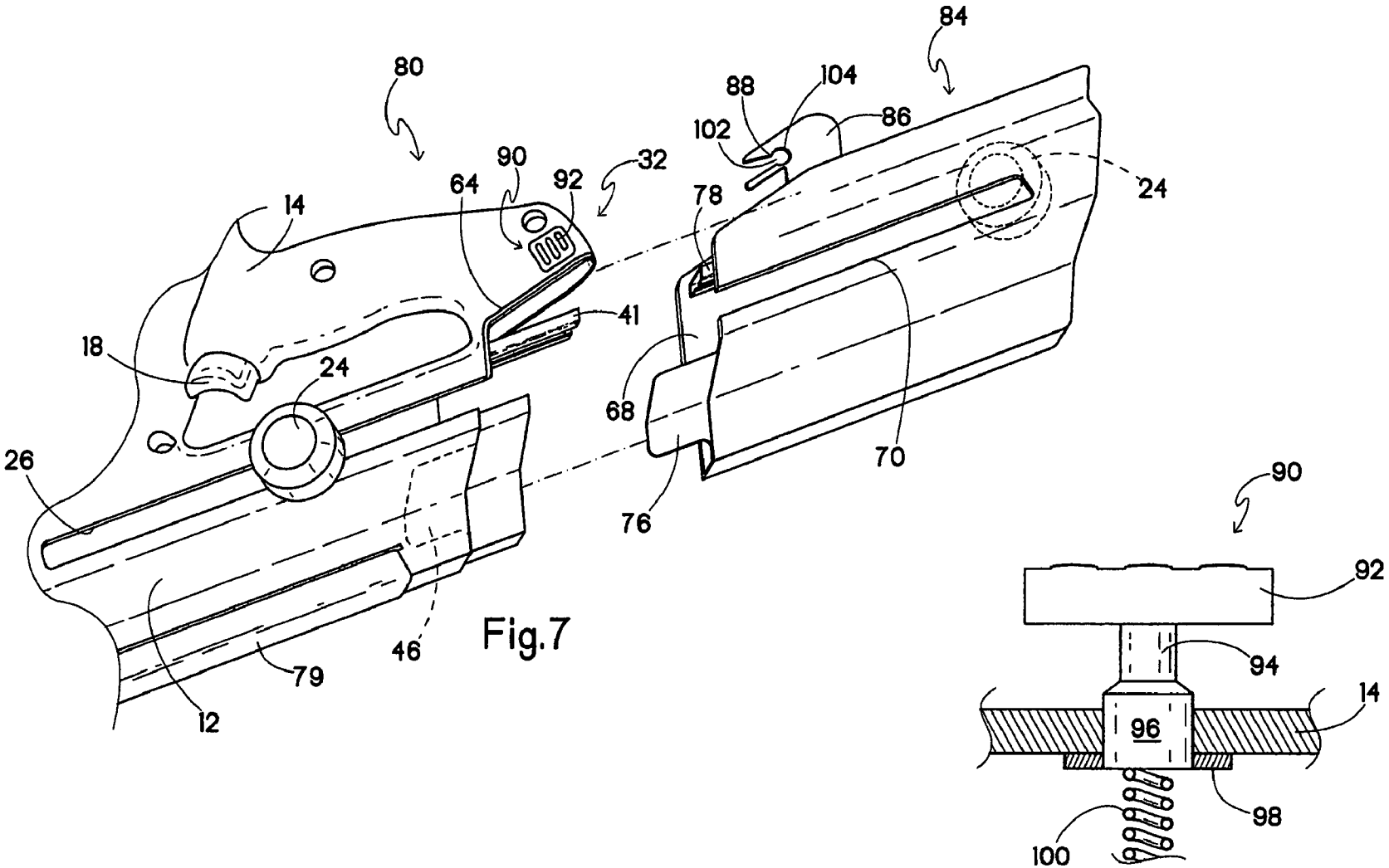
FIG. 7 is a fragmentary perspective view of the tool of FIG. 5 with the extension shown exploded away.
FIG. 8 is a side elevation of the release button employed in the tool of FIG. 5.

Referring now to FIGS. 5-7, an alternate embodiment to the magazine 12 is generally designated 80. Shared components are designated with the identical reference numbers. The operation of the two embodiments 10, 80 is essentially the same, with an endcap 82 used for single strip fastener accommodation. As is the case with the endcap 34, the endcap 82 is optional. When the capacity for accommodating multiple strips of fasteners is desired, an extension 84 replaces the endcap 82. A main distinction between the embodiments 10 and 80 is the latch mechanism, specifically the construction of the endcap 82 and the extension 84, which each have a tab 86 with a forward-opening, generally keyhole-shaped aperture 88. The aperture 88 is constructed and arranged for releasably locked engagement with a latch button 90. A rear portion of the housing 14 is provided with a slot (not shown) to accommodate the tab 86 when the endcap 82 or the extension 86 is attached.

Referring to FIG. 8, the latch button 90 is similar in function to the latch button 56, but distinct in construction. The button 90 is generally axially aligned, with a finger pad 92 secured to a narrowed neck 94. At a lower end, the neck 94 is connected to a relatively larger diameter barrel portion 96 with at least one and preferably two radially extending wing tabs 98, a radially extending disk or other equivalent structure provided to retain the button 90 in the housing 14. A biasing element 100, such as a coiled spring or the like described above in relation to the biasing element 58, is accommodated in the barrel 96 and biases the latch button 90 to a locked position, holding either the endcap 82 or the extension 84 in place.

The narrow neck 94 is configured to slidingly engage a narrow portion 102 of the keyhole aperture 88, and the barrel portion 96 is configured to slidingly engage a generally circular, larger diameter portion 104 of the keyhole aperture. Thus, in the locked position, the barrel portion 96 and the large diameter portion 104 are in engagement. To release either the endcap 82 or the extension 84, the latch button 90 is depressed against the biasing force of the biasing element 100 to align the neck 94 with the narrow portion 102 and permit release of the respective magazine housing component in a rearward direction.

Figure 11:
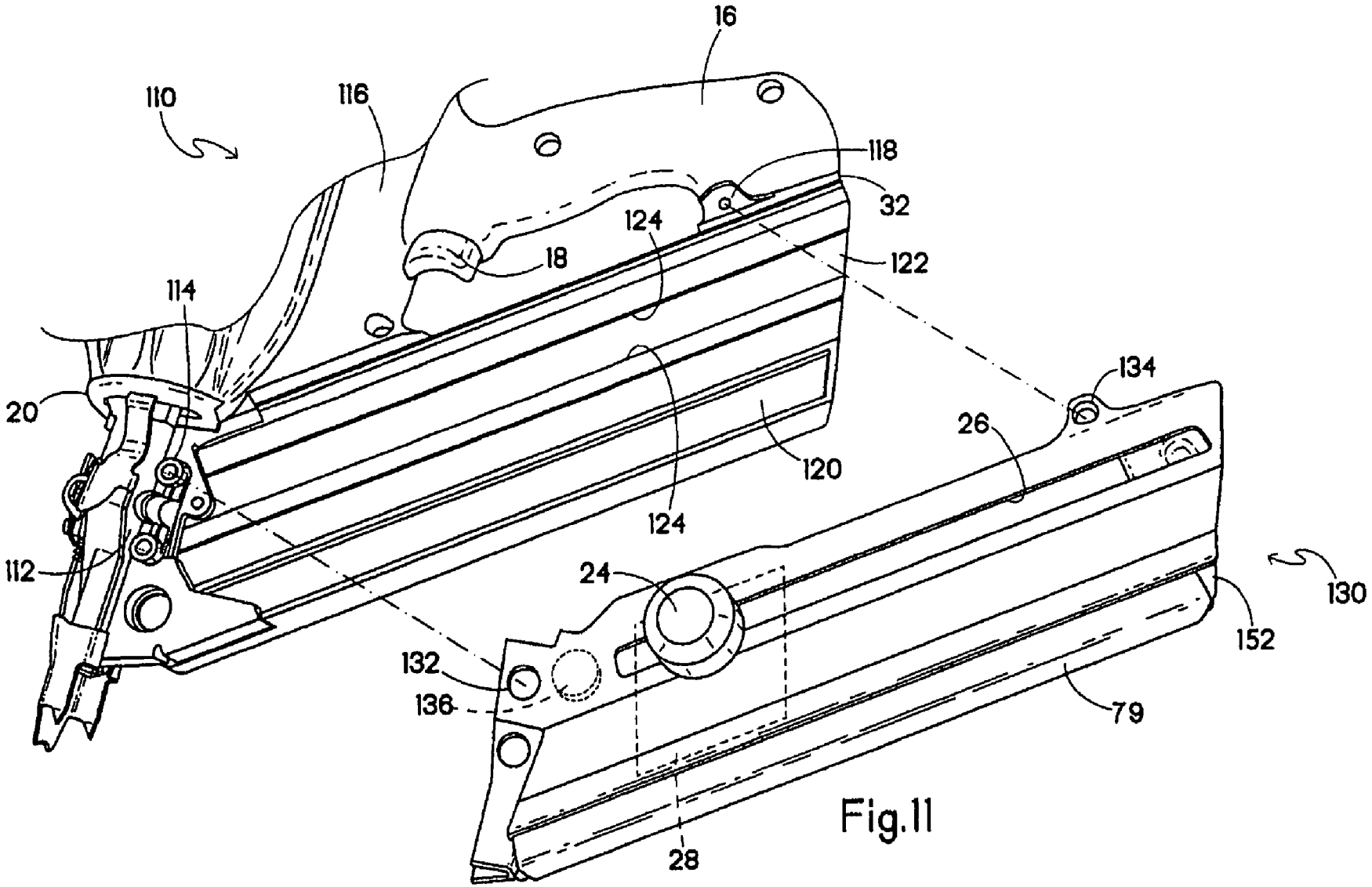
FIG. 11 is an exploded perspective view of another alternate embodiment of the present tool with a single strip magazine.
Figures 12, 13, 14:
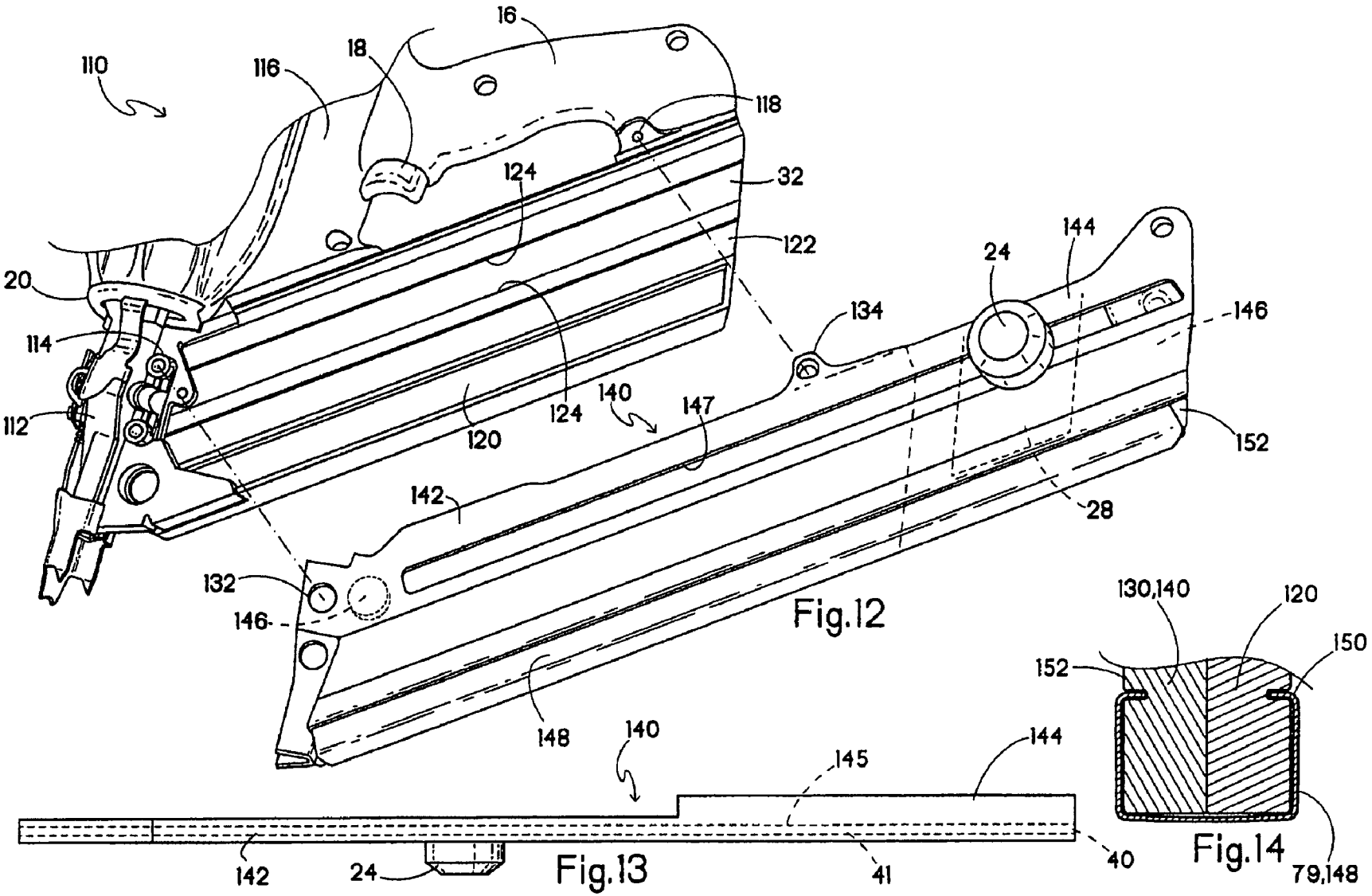
FIG. 12 is an exploded perspective view of the tool of FIG. 11 with a magazine extension.
FIG. 13 is an overhead plan view of the magazine extension of FIG. 12.
FIG. 14 is a fragmentary section showing the magazine of FIGS. 11 and 12 shown assembled.

Referring now to FIGS. 11, 12 and 13, an alternate embodiment of the present tool 10 is generally designated 110. Components shared with the embodiments 10 and 80 are designated with identical reference numbers. The operation of the tool 110 is generally the same as that of the tool 10, with the main distinction being the manner in which the magazine is assembled upon the tool. As seen in FIG. 11, a nosepiece 112 has at least one and preferably two threaded sockets 114 formed therein, preferably by casting and subsequent machining, however other fabrication techniques are contemplated. Also, a main housing 116 has a mounting point 118 near the handle portion 16. A first magazine housing portion is provided in the form of a half magazine 120 split along its length and extending from the nosepiece 112 to the rear end 32. As shown, the half magazine 120 has the capacity for at least a single strip of fasteners. An inner wall 122 has a pair of laterally extending corrugations 124 for slidably guiding and/or supporting fasteners toward the nosepiece 112. Note that this part of the tool 110 lacks the follower 28, the return spring 30, the follower handle 24, and the fastener track 41.

Referring now to FIG. 11, a second magazine housing portion, represented by a magazine half, is generally designated 130 and is sized to accommodate at least a single strip of fasteners. Further, the housing portion 130 is configured to engage the tool 110 to align with the half magazine 120, providing a complementary half of the magazine. Fastener eyelets 132, 134 respectively align with the threaded socket(s) 114 and the mounting point 118 for securing the housing portion 130 to the half magazine 120 using threaded fasteners or the like. A set of two eyelets 132 is shown from the inboard side of the housing portion 130 in FIG. 9. Once joined, at the rear end 32 the portions 120, 130 form a fastener feed entry slot 40 (FIG. 10). The portion 130 has a follower 28, a follower return spring 136 (both shown hidden), and a follower handle 24. Differences between the housing portion 130 and the first magazine housing portion 36 (FIG. 1) include that the former contains the follower 28, the follower handle 24 and the return spring 30, whereas the housing portion 130 contains the follower 28, the follower handle 24 and the return spring 136. Another difference is that the first magazine housing portion 36 has a follower return spring 30 capable of accommodating at least two strips of fasteners, while the spring 136 in the portion 130 can only accommodate a single strip of fasteners, as does the rest of the portion.

Referring now to FIGS. 9, 11, 12 and 13, an extension portion for the embodiment 110 is generally designated 140. The extension portion 140 shares components with the second magazine housing portion 130, which are designated with identical reference numbers. A main difference between the extension portion 140 and the second magazine housing portion 130 is that the former is dimensioned to accommodate at least two strips of fasteners. A front end 142 of the extension 140 is a complementary half to the half magazine 120 in the same manner of the portion 130, forming an assembled magazine chamber. However, since a rear end 144 extends beyond the rear end 32 of the tool 110, it includes an enclosed magazine chamber 145 defining the fastener feed entry slot 40 (both shown hidden). In other words, the rear end 144 includes both complementary magazine halves (best seen in FIG. 13). Also, it will be understood that the extension 140 includes its own follower 28, follower handle 24, a follower return spring 146 which is of a sufficient length to accommodate at least two strips of fasteners, and a relatively long follower channel 147. The enclosed magazine chamber 145 is in communication with the assembled chamber formed by the attachment of the front end 142 to the half magazine 120.

It will be understood that both the housing portion 130 and the extension 140 have a fastener track 41 for slidably receiving fasteners fed in the entry slot 40. In addition, both the housing portion 130 and the extension 140 include a generally "U"-shaped clamping clip or bracket 79, 148 which slidably engages lower edges of the complementary halves and holds them together. The clip 148 is of the same cross-sectional configuration as the clip 79, but is longer. As seen in FIG. 14, inwardly projecting edges 150 engage grooves 152 in the halves 120, 130, and 120, 140.

In the tool 110, when the user needs to change from a magazine accommodating a single strip to a double strip application, he removes the fasteners at points 114, 118 and slides the clip 79 rearward in the grooves 152. The second magazine housing portion 130, along with its return spring 30, follower 28 and follower handle 24 is removed and replaced by the extension 140, being assembled with a reverse procedure. As in all of the embodiments, fasteners are fed through the entry slot 40.

Several advantages are offered by the present design. The manufacturing and retail costs are reduced due to the lack of component duplication. The user is offered the flexibility of a variety of magazine capacities to suit various applications. Tool and component storage requirements are also reduced, since the present magazine extension is shorter than a supplemental multiple strip capacity magazine or even a standard single strip capacity magazine.

While specific embodiments of the present modular magazine for a fastener driving tool have been shown and described, it will be appreciated by those skilled in the art that changes and modifications may be made thereto without departing from the invention in its broader aspects and as set forth in the following claims.

The invention claimed is:

1. A modular magazine assembly in a fastener-driving tool having a nosepiece, said assembly comprising:

a first magazine housing portion secured to said tool and at least partially defining a chamber for receiving fasteners;

an extension portion configured for releasable attachment to said first magazine housing portion, such that upon assembly of said extension portion, a resulting large capacity magazine is defined and dimensioned to accommodate at least two fastener strips in an end-to-end arrangement;

a second magazine housing portion releasably secured to said tool and, with said first magazine housing portion, defining a magazine for at least one fastener strip;

wherein said extension portion is securable to said first magazine housing portion upon removal of said second housing portion; and said first magazine housing portion defines a first portion of a fastener track, and at least one of said second magazine housing portion and said extension portion defines a second portion of said fastener track.

2. The assembly of claim 1 wherein said second magazine housing portion is an endcap.

3. The assembly of claim 1 wherein said first magazine housing portion includes a return spring and a follower with a capacity of at least one fastener strip.

4. The assembly of claim 3 wherein said return spring has a capacity of at least two fastener strips.

5. The assembly of claim 1 wherein said first magazine housing portion defines a chamber with the capacity for a single strip of fasteners, and said extension portion defines an extension chamber with the capacity for a second strip of fasteners.

6. The assembly of claim 1 including a locking formation on at least one of said second magazine housing portion and said extension portion for lockingly engaging a latch on said tool.

7. The assembly of claim 6 wherein said locking formation includes an aperture configured for engagement by a biased latch button.

8. A modular magazine assembly for a fastener driving tool, comprising:

a first magazine housing portion having a nosepiece end, an opposite fastener loading end and at least partially defining a chamber having a track configured for receiving fasteners in a first orientation;

a follower slidably engaged in said first magazine housing portion for urging fasteners in the first orientation toward said nosepiece end;

a follower spring associated with said first magazine housing portion and connected to said follower to bias said follower toward said nosepiece end, said follower spring configured for urging multiple strips of fasteners; and an extension portion engageable with said fastener loading end without the use of tools and configured for receiving said follower so that multiple strips of fasteners are urged by said follower spring in the first orientation toward said nosepiece end, wherein said first magazine housing portion and said extension portion urge said fasteners in the same direction.

9. The assembly of claim 8 wherein said first magazine housing portion defines a first portion of a fastener track, and said extension portion defines a second portion of a fastener track, said first and second fastener track portions being in registry with each other.

10. The assembly of claim 9 further including a follower channel defined in said first magazine housing portion, and an extension follower channel defined in said extension portion, said follower channels being in registry with each other.

11. The assembly of claim 8 further including a second magazine housing portion removably attachable to said fastener loading end of said first magazine housing portion.

* * * * *